US010422202B2

(12) United States Patent
Kellner et al.

(10) Patent No.: US 10,422,202 B2
(45) Date of Patent: Sep. 24, 2019

(54) LINEARLY INDEXING WELLBORE VALVE

(71) Applicant: TEAM OIL TOOLS, LP, The Woodlands, TX (US)

(72) Inventors: Justin Kellner, Adkins, TX (US); Wayland Dale Connelly, Montgomery, TX (US); Kenneth J. Anton, Houston, TX (US); Michael J. Harris, Houston, TX (US)

(73) Assignee: INNOVEX DOWNHOLE SOLUTIONS, INC., Houston, TX (US)

( * ) Notice: Subject to any disclaimer, the term of this patent is extended or adjusted under 35 U.S.C. 154(b) by 322 days.

(21) Appl. No.: 15/337,920

(22) Filed: Oct. 28, 2016

(65) Prior Publication Data

US 2017/0044870 A1 Feb. 16, 2017

Related U.S. Application Data

(63) Continuation-in-part of application No. 14/290,410, filed on May 29, 2014, now Pat. No. 9,896,908, (Continued)

(51) Int. Cl.
*E21B 34/14* (2006.01)
*E21B 23/00* (2006.01)
(Continued)

(52) U.S. Cl.
CPC ..... *E21B 34/14* (2013.01); *E21B 23/004* (2013.01); *E21B 43/14* (2013.01); *E21B 43/26* (2013.01); *E21B 2034/007* (2013.01)

(58) Field of Classification Search
CPC .. E21B 34/14; E21B 2034/007; E21B 23/004; E21B 43/26
See application file for complete search history.

(56) References Cited

U.S. PATENT DOCUMENTS 3,011,548 A 7/1958 Holt
4,893,678 A 1/1990 Stokely et al.
(Continued)

FOREIGN PATENT DOCUMENTS

EP 0198406 A1 10/1986
GB 1359961 7/1974
(Continued)

OTHER PUBLICATIONS

Author Unknown, Annex to Form PCT/ISA/206 Communication Relating to the Results of the Partial International Search Report dated Jan. 27, 2016, PCT Application No. PCT/US2015/056342, pp. 1-2.

(Continued)

*Primary Examiner* — Blake E Michener
(74) *Attorney, Agent, or Firm* — MH2 Technology Law Group LLP

(57) ABSTRACT

A downhole tool and method for actuating a downhole tool, of which the downhole tool includes a housing having a housing port formed radially-therethrough, a shifter sleeve positioned within the housing, wherein the shifter sleeve has a port formed radially therethrough, and a drive sleeve positioned at least partially within an annulus between the housing and the shifter sleeve. Downward movement of the shifter sleeve causes the drive sleeve to move downward, and downward movement of the drive sleeve causes fluid to flow through the port in the shifter sleeve and into the annulus. The downhole tool also includes a filter coupled to the shifter sleeve and configured to prevent particles from flowing through the port in the shifter sleeve and into the annulus.

23 Claims, 11 Drawing Sheets

Related U.S. Application Data which is a continuation-in-part of application No. 13/987,053, filed on Jun. 28, 2013, now Pat. No. 9,458,698, and a continuation-in-part of application No. 14/229,362, filed on Mar. 28, 2014, now Pat. No. 8,863,853, which is a continuation-in-part of application No. 13/987,053, filed on Jun. 28, 2013, now Pat. No. 9,458,698, application No. 15/337,920, which is a continuation-in-part of application No. 14/309,861, filed on Jun. 19, 2014, now abandoned, which is a continuation-in-part of application No. 13/987,053, filed on Jun. 28, 2013, now Pat. No. 9,458,698, and a continuation-in-part of application No. 14/229,362, filed on Mar. 28, 2014, now Pat. No. 8,863,853, which is a continuation-in-part of application No. 13/987,053, filed on Jun. 28, 2013, now Pat. No. 9,458,698.

(51) Int. Cl.

| | |
|---|---|
| ***E21B 43/14*** | (2006.01) |
| ***E21B 43/26*** | (2006.01) |
| *E21B 34/00* | (2006.01) |

(56) References Cited

U.S. PATENT DOCUMENTS

| | | | | |
|---|---|---|---|---|
| 5,058,671 | A | 10/1991 | Cochran | |
| 5,375,662 | A | 12/1994 | Echols et al. | |
| 5,810,084 | A | 9/1998 | Echols | |
| 6,059,032 | A | 5/2000 | Jones | |
| 6,634,428 | B2 | 10/2003 | Krauss et al. | |
| 6,866,100 | B2 | 3/2005 | Gudmestad et al. | |
| 6,907,936 | B2 | 6/2005 | Fehr et al. | |
| 7,108,067 | B2 | 9/2006 | Themig et al. | |
| 7,322,417 | B2 | 1/2008 | Rytlewski et al. | |
| 7,325,616 | B2 | 2/2008 | de Cardenas | |
| 7,377,321 | B2 | 5/2008 | Rytlewski | |
| 7,387,165 | B2 | 6/2008 | de Cardenas et al. | |
| 7,416,029 | B2 | 8/2008 | Telfer et al. | |
| 7,581,596 | B2 | 9/2009 | Reimert et al. | |
| 7,644,772 | B2 | 1/2010 | Avant et al. | |
| 7,661,478 | B2 | 2/2010 | Palmer et al. | |
| 8,181,701 | B2 | 5/2012 | Yokley et al. | |
| 8,261,761 | B2 | 9/2012 | Gerrard et al. | |
| 8,276,674 | B2 | 10/2012 | de Cardenas et al. | |
| 8,291,988 | B2 | 10/2012 | King | |
| 8,443,984 | B2 | 5/2013 | Coghill et al. | |
| 8,479,808 | B2 | 7/2013 | Gouthaman | |
| 8,505,632 | B2 | 8/2013 | Guerrero et al. | |
| 8,522,885 | B2 | 9/2013 | Giroux et al. | |
| 8,668,006 | B2 | 3/2014 | Xu | |
| 8,789,600 | B2 | 7/2014 | O'Connell et al. | |
| 8,863,853 | B1 * | 10/2014 | Harris | E21B 23/004 166/318 |
| 9,097,079 | B2 | 8/2015 | Themig | |
| 2001/0045288 | A1 | 11/2001 | Allamon et al. | |
| 2003/0070809 | A1 * | 4/2003 | Schultz | E21B 34/063 166/278 |
| 2003/0136563 | A1 | 7/2003 | Allamon et al. | |
| 2004/0035586 | A1 | 2/2004 | Gudmestad et al. | |
| 2004/0045714 | A1 | 3/2004 | McGavern, III et al. | |
| 2004/0069496 | A1 | 4/2004 | Hosie et al. | |
| 2004/0108109 | A1 | 6/2004 | Allamon et al. | |
| 2004/0118564 | A1 | 6/2004 | Themig et al. | |
| 2004/0154839 | A1 | 8/2004 | McGarian et al. | |
| 2007/0272411 | A1 | 11/2007 | de Cardenas et al. | |
| 2008/0093080 | A1 | 4/2008 | Palmer et al. | |
| 2009/0011247 | A1 | 1/2009 | Barlow | |
| 2009/0084553 | A1 | 4/2009 | Rytlewski et al. | |
| 2009/0308588 | A1 | 12/2009 | Howell et al. | |
| 2010/0243254 | A1 | 9/2010 | Murphy et al. | |
| 2010/0270030 | A1 | 10/2010 | Asby et al. | |
| 2011/0042068 | A1 | 2/2011 | Rogers et al. | |
| 2011/0192607 | A1 | 8/2011 | Hofman et al. | |
| 2011/0203800 | A1 | 8/2011 | Tinker et al. | |
| 2011/0240301 | A1 | 10/2011 | Robison et al. | |
| 2011/0278017 | A1 | 11/2011 | Themig et al. | |
| 2012/0073828 | A1 | 3/2012 | Churchill | |
| 2012/0168163 | A1 | 7/2012 | Bertoja et al. | |
| 2012/0199341 | A1 | 8/2012 | Kellner et al. | |
| 2012/0199349 | A1 | 8/2012 | Themig et al. | |
| 2012/0205121 | A1 | 8/2012 | Porter et al. | |
| 2012/0261131 | A1 | 10/2012 | Hofman et al. | |
| 2013/0025868 | A1 | 1/2013 | Smith et al. | |
| 2013/0025876 | A1 | 1/2013 | McCoy et al. | |
| 2013/0048273 | A1 | 2/2013 | Crow et al. | |
| 2013/0048298 | A1 * | 2/2013 | Merron | E21B 34/14 166/373 |
| 2013/0068475 | A1 | 3/2013 | Hofman et al. | |
| 2013/0118732 | A1 | 5/2013 | Chauffe et al. | |
| 2013/0153220 | A1 | 6/2013 | Carter et al. | |
| 2013/0255963 | A1 | 10/2013 | Guerrero et al. | |
| 2013/0299199 | A1 | 11/2013 | Naedler et al. | |
| 2015/0000920 | A1 * | 1/2015 | Harris | E21B 23/004 166/308.1 |
| 2015/0000922 | A1 * | 1/2015 | Harris | E21B 34/14 166/319 |

FOREIGN PATENT DOCUMENTS

| | | | |
|---|---|---|---|
| GB | 2323871 | A | 10/1998 |
| GB | 2389608 | A | 12/2003 |
| WO | 1996/034176 | A2 | 10/1996 |
| WO | 1996/034176 | A3 | 10/1996 |
| WO | 2001/04457 | A1 | 1/2001 |
| WO | 2001/90529 | A1 | 11/2001 |
| WO | 2002/14650 | A1 | 2/2002 |
| WO | 2002/061236 | A1 | 8/2002 |
| WO | 2004/031533 | A2 | 4/2004 |
| WO | 2004/031533 | A3 | 4/2004 |
| WO | 2004/083590 | A2 | 9/2004 |
| WO | 2004/083590 | A3 | 9/2004 |
| WO | 2004/088091 | A1 | 10/2004 |
| WO | 2005/085584 | A1 | 9/2005 |
| WO | 2006/134446 | A2 | 12/2006 |
| WO | 2006/134446 | A3 | 12/2006 |
| WO | 2010/129678 | A2 | 11/2010 |
| WO | 2013/016822 | A1 | 2/2013 |
| WO | 2014043806 | A1 | 3/2014 |

OTHER PUBLICATIONS

Examiner's Report dated Nov. 6, 2015, Canadian Application No. 2,855,083, pp. 1-4.

Mihnea Georgescu (Authorized Officer), International Search Report dated Mar. 19, 2015, PCT Application No. PCT/US2014/044445, pp. 1-4.

Author Unknown, Written Opinion dated Mar. 16, 2015, PCT Application No. PCT/US2014/044445, pp. 1-6.

Baker Hughes, FracPoint EX-C Frac Sleeve System, © 2011 Baker Hughes Incorporated, 1 page.

Halvorsen et al., Practical Aspects of In-situ Ball Seat Milling, SPE Annual Technical Conference and Exhibition, Oct. 30 to Nov. 2, 2011, Denver, CO (SPE) (abstract), pp. 1-2.

Halliburton, Horizontal Completion Systems, pp. 1-20.

Dawson et al., New Setting Technique for Gravel Pack Packers Increases Operational Safety and Reduces Costs, SPE Asia Pacific Oil and Gas Conference and Exhibition, Sep. 9-11, 2003, Jakarta, Indonesia (SPE) (abstract), pp. 1-2.

Schlumberger, Falcon Ball-Actuated Frac Valve, © 2012 Schlumberger, pp. 1-2.

Schlumberger, Falcon Hydraulic-Actuated Frac Valve, © 2012 Schlumberger, 1 page.

Weatherford, Real Results—ZoneSelect i-ball Multi-zone Fracturing Sleeves Isolate, Fracture 6 Lower Horizontal Openhole Sections in Bakken Shale, © 2012 Weatherford, 1 page.

Weatherford, ZoneSelect i-ball Stimulation Sleeve, © 2013 Weatherford, pp. 1-2.

(56) References Cited

OTHER PUBLICATIONS

Author Unknown, International Search Report, PCT Application No. PCT/US2014/044446, accessed Jul. 20, 2015, pp. 1-7.
Author Unknown, Written Opinion of the International Searching Authority, PCT Application No. PCT/US2014/044446, accessed Jul. 20, 2015, pp. 1-11.
Advanced Frac Systems, Sidewinder Multiple Zone Stimulation Sleeve, © 2014 Advanced Frac Systems, pp. 1-2.
Non-Final Office Action dated Nov. 29, 2016, U.S. Appl. No. 14/290,410, filed May 29, 2014, pp. 1-24.

* cited by examiner

LINEARLY INDEXING WELLBORE VALVE

CROSS-REFERENCE TO RELATED APPLICATIONS

This application is a continuation-in-part of U.S. patent application Ser. No. 14/290,410, filed on May 29, 2014, which is a continuation-in-part of U.S. patent application Ser. No. 13/987,053, now U.S. Pat. No. 9,458,698, filed on Jun. 28, 2013, and which is a continuation-in-part of U.S. patent application Ser. No. 14/229,362, now U.S. Pat. No. 8,863,853, filed on Mar. 28, 2014, which is a continuation-in-part of U.S. patent application Ser. No. 13/987,053, now U.S. Pat. No. 9,458,698, which was filed on Jun. 28, 2013. This application is also a continuation-in-part of U.S. patent application Ser. No. 14/309,861, filed on Jun. 19, 2014, which is a continuation-in-part of U.S. patent application Ser. No. 13/987,053, now U.S. Pat. No. 9,458,698, filed on Jun. 28, 2013 and which is a continuation-in-part of U.S. patent application Ser. No. 14/229,362, now U.S. Pat. No. 8,863,853, filed on Mar. 28, 2014, which is a continuation in part of U.S. patent application Ser. No. 13/987,053, now U.S. Pat. No. 9,458,698, filed on Jun. 28, 2013. Each of these priority documents is incorporated herein by reference in its entirety.

BACKGROUND

Conventional fracturing or "frac" valves typically include a cylindrical housing that may be threaded into and form a part of a production liner. The housing defines an axial bore through which frac fluids and other well fluids may flow. Ports are provided in the housing that may be opened by actuating a sliding sleeve. Once the ports are opened, fluids are able to flow through the ports and fracture a formation in the vicinity of the valve.

The sliding sleeves in such valves are typically actuated either by creating hydraulic pressure behind the sleeve or by dropping a ball on a ball seat connected to the sleeve. Some multi-stage fracking systems use both hydraulic pressure and balls. More particularly, some systems include a hydraulically-actuated sliding sleeve valve which, when the liner is run into the well, is located near the bottom of the wellbore in the first fracture zone.

Such valves have been used successfully in many applications. However, in some hydraulically-actuated valves, relatively small chambers are formed therein that are in communication with the interior bore of the tool. These chambers can thus become fouled with debris from the fluid in the bore, potentially impacting the reliability of the valve actuation.

SUMMARY

Embodiments of the disclosure may provide a downhole tool that includes a housing having a housing port formed radially-therethrough, a shifter sleeve positioned within the housing, wherein the shifter sleeve has a port formed radially therethrough, and a drive sleeve positioned at least partially within an annulus between the housing and the shifter sleeve. Downward movement of the shifter sleeve causes the drive sleeve to move downward, and downward movement of the drive sleeve causes fluid to flow through the port in the shifter sleeve and into the annulus. The downhole tool also includes a filter coupled to the shifter sleeve and configured to prevent particles from flowing through the port in the shifter sleeve and into the annulus.

Embodiments of the disclosure may also provide a downhole tool that includes a housing having a housing port formed radially-therethrough, and a shifter sleeve positioned within the housing. The shifter sleeve has a port formed radially therethrough. The downhole tool also includes an actuation ball seat coupled to and configured to move together with the shifter sleeve, and a drive sleeve positioned at least partially within an annulus between the housing and the shifter sleeve. Downward movement of the shifter sleeve causes the drive sleeve to move downward, and downward movement of the drive sleeve causes fluid to flow through the port in the shifter sleeve and into the annulus. The downhole tool further includes a filter coupled to the shifter sleeve and configured to prevent particles from flowing through the port in the shifter sleeve and into the annulus, and a valve sleeve positioned within the housing and below the drive sleeve. The valve sleeve has a valve sleeve port formed radially-therethrough that is misaligned with the housing port when the valve sleeve is in a first position and aligned with the housing port when the valve sleeve is in a second position. The downhole tool additionally includes an isolation ball seat positioned at least partially within the valve sleeve.

Embodiments of the disclosure may further provide a method for actuating a downhole tool. The method includes running the downhole tool into a wellbore, and introducing a first ball into a bore of the downhole tool. The first ball is received in an actuation ball seat of the downhole tool and causes the actuation ball seat and a shifter sleeve coupled thereto to move downward within a housing of the downhole tool. Downward movement of the shifter sleeve causes a drive sleeve to move downward within the housing. Downward movement of the drive sleeve causes fluid to flow through a port in the shifter sleeve and into an annulus between the housing and the shifter sleeve. A filter coupled to the shifter sleeve prevents particles from flowing through the port in the shifter sleeve and into the annulus.

BRIEF DESCRIPTION OF THE DRAWINGS

The present disclosure may best be understood by referring to the following description and accompanying drawings that are used to illustrate embodiments of the invention. In the drawings.

DETAILED DESCRIPTION

Figure 1A:
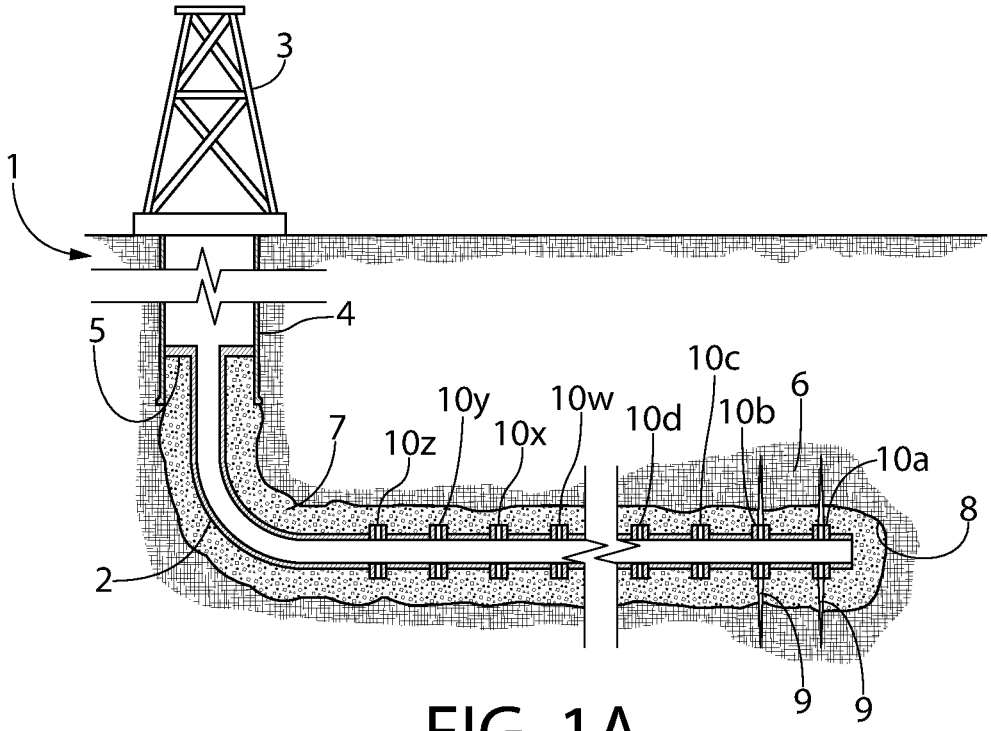
FIG. 1A illustrates a schematic view of a wellbore showing the initial stages of a downhole operation (e.g., a frac job), according to an embodiment.

The following disclosure describes several embodiments for implementing different features, structures, or functions of the invention. Embodiments of components, arrangements, and configurations are described below to simplify the present disclosure; however, these embodiments are provided merely as examples and are not intended to limit the scope of the invention. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the embodiments presented below may be combined in any combination of ways, e.g., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. In addition, unless otherwise provided herein, "or" statements are intended to be non-exclusive; for example, the statement "A or B" should be considered to mean "A, B, or both A and B."

In general, the present disclosure is directed to a downhole tool. The downhole tool may include a housing having a housing port formed radially-therethrough. A shifter sleeve may be positioned within the housing and have a port formed radially therethrough. A drive sleeve may be positioned at least partially within an annulus between the housing and the shifter sleeve. Downward movement of the shifter sleeve may cause the drive sleeve to move downward, and downward movement of the drive sleeve may cause fluid to flow through the port in the shifter sleeve and into the annulus. A filter may be coupled to the shifter sleeve and configured to prevent particles from flowing through the port in the shifter sleeve and into the annulus. A piston may be positioned in the annulus and below the drive sleeve. The piston may help keep the annulus pressure-balanced.

Turning to the specific embodiments, FIG. 1A illustrates a schematic view of a wellbore 1 showing the initial stages of a downhole operation (e.g., frac job), according to an embodiment. A production liner 2 may be positioned within the wellbore 1. The production liner 2 may include a plurality of downhole tools (eight are shown: 10*a-d*, 10*w-z*). The downhole tools 10*a-d*, 10*w-z* may be or include valves (e.g., frac valves). The wellbore 1 may be serviced by a derrick 3 and various other surface equipment. The upper portion of the wellbore 1 may have a casing 4 positioned therein. The production liner 2 may be installed in the lower portion of casing 4 via a liner hanger 5. The lower part of the wellbore 1 may extend generally horizontally through a hydrocarbon bearing formation 6, and the liner 2 may secured in place by cement 7.

Figure 1B:
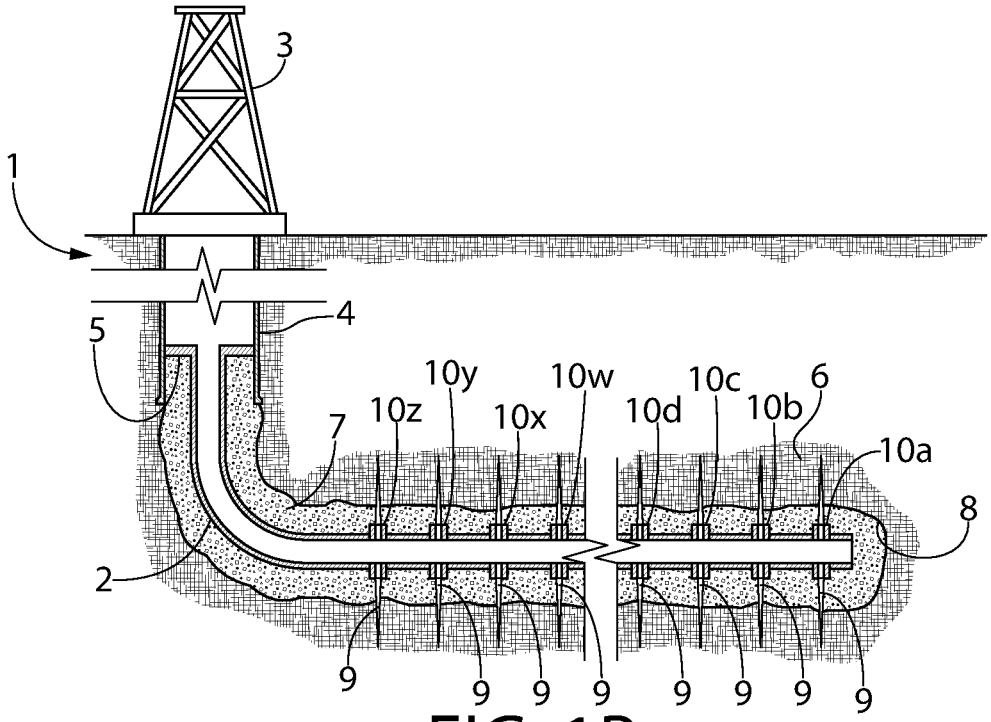
FIG. 1B illustrates a schematic view of the wellbore after the downhole operation has been completed, according to an embodiment.

The downhole operation (e.g., frac job) may generally proceed from the lowermost zone in the wellbore 1 to the uppermost zone. FIG. 1A, therefore, shows that fractures 9 have been established adjacent to tools 10*a* and 10*b* in the first two zones near the bottom of wellbore 1. Zones further uphole in the wellbore 1 may be fracked in succession until, as shown in FIG. 1B, all stages of the frac job have been completed, and fractures 9 have been established in all zones.

Figure 2:
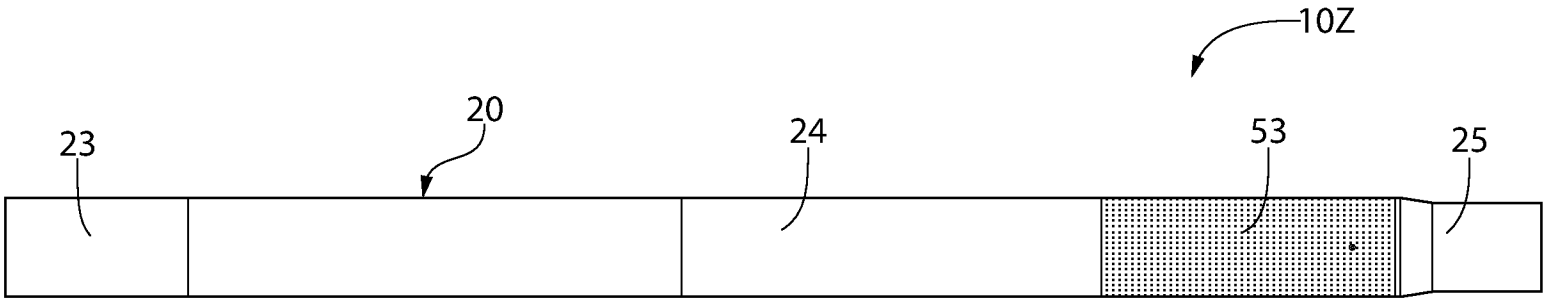
FIG. 2 illustrates a side view of a downhole tool in a first (e.g., closed) state, according to an embodiment.
Figure 3:
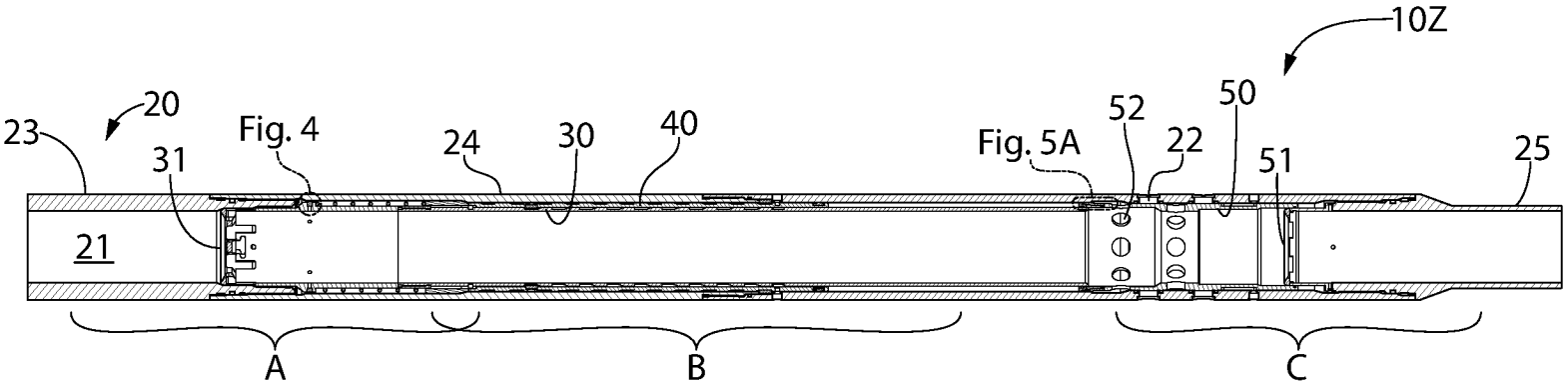
FIG. 3 illustrates a cross-sectional side view of the downhole tool in the first state, according to an embodiment.

FIGS. 2 and 3 illustrate a side view and a cross-sectional side view of one of the downhole tools (e.g., the uppermost downhole tool 10*z*) in a first (e.g., closed) state, according to an embodiment. The downhole tool 10*z* may include a housing 20. The housing 20 may be one integral component or multiple components coupled together. As shown, the housing 20 includes an upper housing sub 23, an intermediate housing sub 24, and a lower housing sub 25 that are coupled (e.g., threaded) together. The upper housing sub 23 and lower housing sub 25 may be configured to be coupled (e.g., threaded) into the production liner 2 or other tubulars. The intermediate housing sub 24 may be or include two or more components that are coupled together. The intermediate housing sub 24 may have valve components positioned therein, such as a shifter sleeve 30, a drive sleeve 40, and a valve sleeve 50.

Referring now to FIG. 3, the housing 20 may define an axial bore 21 that extends through the shifter sleeve 30, the drive sleeve 40, and the valve sleeve 50. An actuation ball seat 31 may be positioned within and/or coupled to the shifter sleeve 30. The actuation ball seat 31 may be configured to selectively receive and release impediments (e.g., balls) that are pumped downhole and into the bore 21 of the downhole tool 10*z*, which may cause the actuation ball seat 31 and the shifter sleeve 30 to move linearly back and forth (e.g., reciprocate) within the intermediate housing sub 24, as described in greater detail below.

The intermediate housing sub 24 may have one or more housing ports 22 formed radially-therethrough that are positioned below the actuation ball seat 31. The housing ports 22 may be axially and/or circumferentially-offset from one another. The housing ports 22 may be covered by a sleeve 53 (FIG. 2), e.g., a thin polymer sleeve configured to break away when fluid flows through the housing ports 22 at a certain pressure. The valve sleeve 50 may also have one or more valve sleeve ports 52 formed radially-therethrough. The valve sleeve ports 52 may be axially and/or circumferentially-offset from one another. The valve sleeve ports 52 may be misaligned with the housing ports 22 when the downhole tool 10*z* is in the first (e.g., closed) state, as shown in FIG. 3. When the ports 22, 52 are misaligned, fluid flow between the bore 21 of the downhole tool 10*z* and the exterior of the downhole tool 10*z* may be prevented.

An isolation ball seat 51 may be positioned within the valve sleeve 50. The isolation ball seat 51 may be configured to allow impediments (e.g. balls) to pass therethrough until the isolation ball seat 51 moves into a reduced diameter portion of the housing 20, at which point the isolation ball seat 51 may receive the next ball, as described in greater detail below. In some embodiments, the isolation ball seat 51 may be coupled to the valve sleeve 50, e.g., such that the isolation ball seat 51 is movable relative to the valve sleeve 50 across a range of positions.

Figure 4:
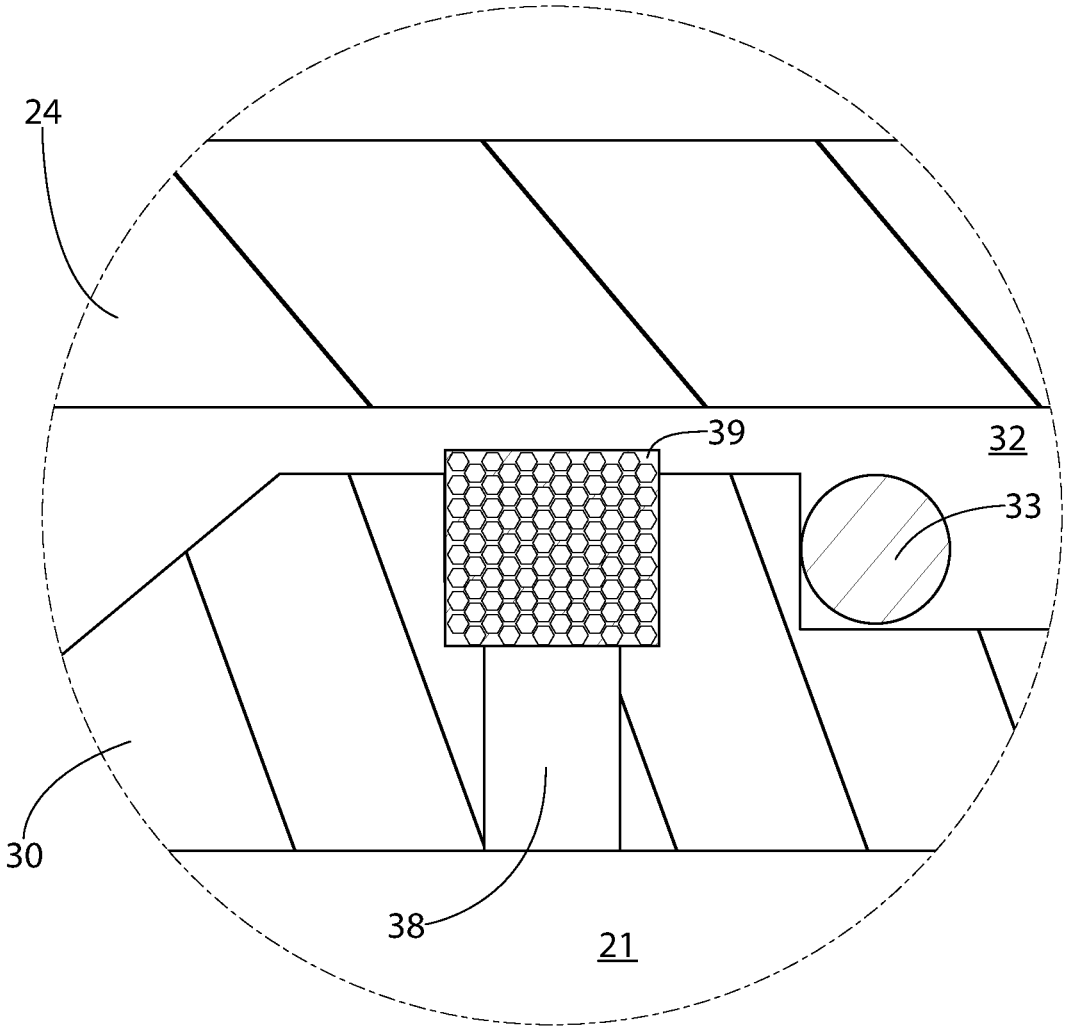
FIG. 4 illustrates an enlarged cross-sectional view of a portion of the downhole tool showing a circulation port having a filter positioned at least partially therein, according to an embodiment.

FIG. 4 illustrates an enlarged cross-sectional view of a portion of the downhole tool 10*z* showing a circulation port 38 having a filter 39 positioned at least partially therein, according to an embodiment. The shifter sleeve 30 may include one or more circulation ports 38 that provide a path of fluid communication between the bore 21 and an annulus 32 formed between the shifter sleeve 30 and the housing 20. Fluid may flow through the circulation ports 38 in response to movement of the drive sleeve 40 in the annulus 32. This may keep the annulus (also referred to as an index chamber) 32 pressure-balanced with the bore 21. The annulus 32 may be filled with fluid (e.g., oil) during assembly.

In at least one embodiment, the filter 39 positioned at least partially within the circulation port 38. In another embodiment, the filter 39 may also or instead be coupled to the inner surface and/or the outer surface of the shifter sleeve 30, covering the circulation ports 38. The filter 39 may be or include a sintered metal (e.g., mesh) material, such as stainless steel (or any other suitable metal, metal alloy, metal matrix, composite, etc.). Further, the sintered metal material may be a two to five ply material.

The filter 39 may prevent solid particles (e.g., debris) in the bore 21 from flowing through the circulation ports 38 and into the annulus 32, where the solid particles may clog the annulus 32. The filter 39 may be, in an embodiment, a 100 micron filter. In other embodiments, the filter 39 size may be larger or smaller, e.g., between about 10 microns and about 500 microns, about 50 microns and about 250 microns, or about 75 microns and about 150 microns. Further, the filter 39 may be configured to prevent particles of a certain size from passing through or out of the circulation port 38. For example, the filter 39 may be configured to prevent particles of greater than or equal to about 0.001 inches, about 0.002 inches, about 0.003 inches, about 0.004 inches, about 0.005 inches, about 0.0010 inches, or about 0.010 inches from passing through or out of the circulation port 38.

Figure 5A:
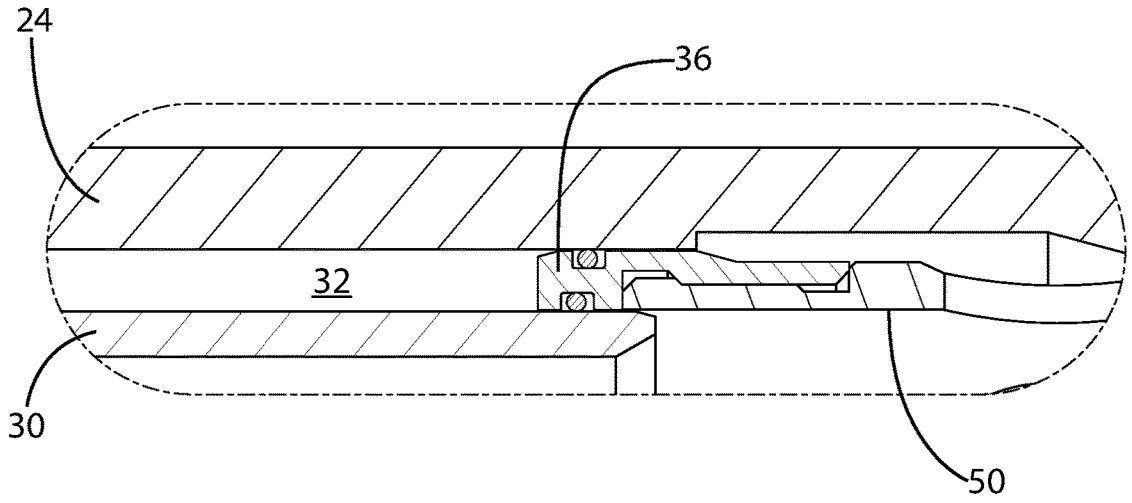
FIG. 5A illustrates an enlarged cross-sectional view of a portion of the downhole tool showing a piston coupled to a valve sleeve, according to an embodiment.
Figure 5B:
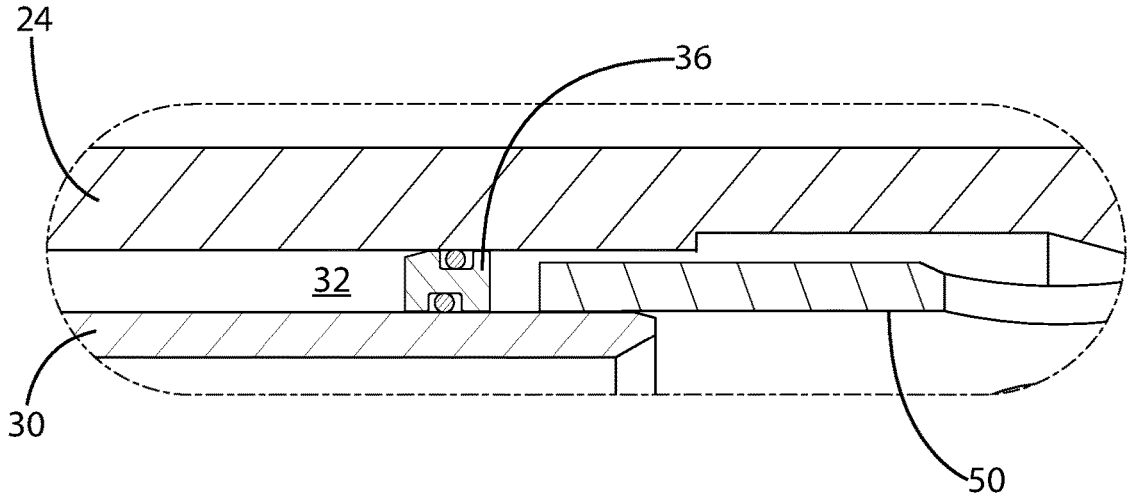
FIG. 5B illustrates an enlarged cross-sectional view of a portion of the downhole tool showing a floating piston, according to an embodiment.

FIG. 5A illustrates an enlarged cross-sectional view of a portion of the downhole tool 10*z* showing a piston 36, according to an embodiment. The piston 36 may be positioned in the annulus 32 and between the drive sleeve 40 and the valve sleeve 50. As shown in FIG. 5A, the piston 36 may be coupled to the upper end of the valve sleeve 50. In another embodiment, the piston 36 may be movable axially within the annulus 32 in response to pressure fluctuations in the annulus 32 (i.e., the piston 36 may be floating), as shown in FIG. 5B. The piston 36 may help keep the annulus 32 pressure-balanced. The piston 36 may include a recess in an inner surface thereof, and a recess in an outer surface thereof for receiving seals (e.g., O-rings).

Figure 6A:
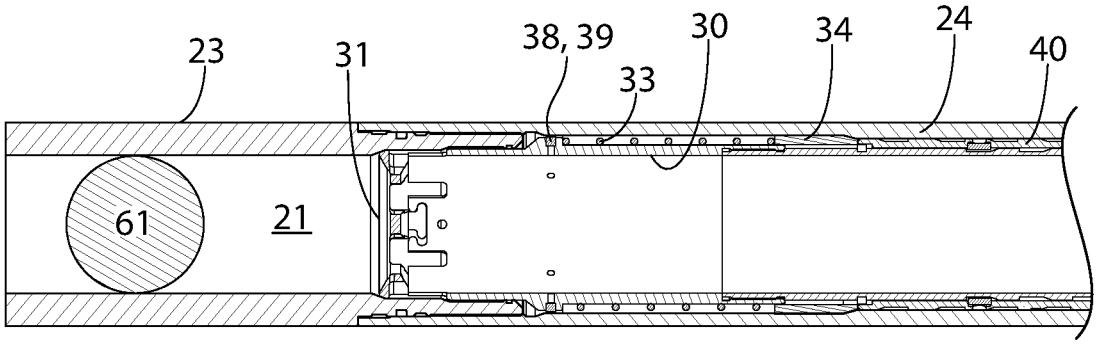
FIGS. 6A, 6B, and 6C illustrate axial cross-sectional views of an upper portion, an intermediate portion, and a lower portion of the downhole tool (e.g., sections A to C shown in FIG. 3) when the downhole tool is run into the wellbore in the first (e.g., closed) state, according to an embodiment.
Figure 6B:
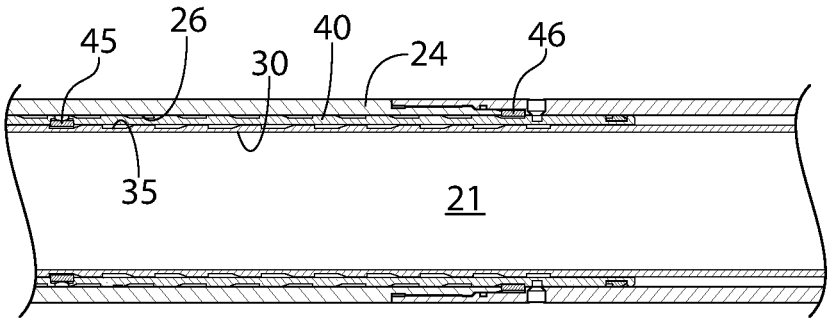
Figure 6C:
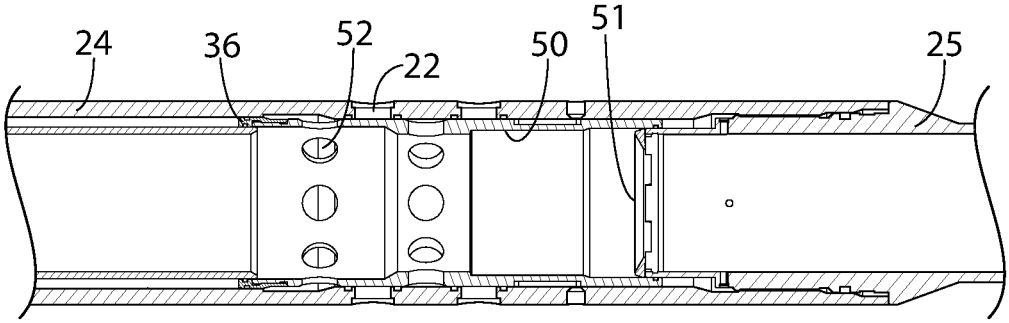

FIGS. 6A-6C illustrate enlarged views of an upper portion, an intermediate portion, and a lower portion (corresponding to sections A, B, and C, respectively, in FIG. 3) of the downhole tool 10*z*, according to an embodiment. Referring first to FIG. 6A, the actuation ball seat 31 may initially be positioned in the reduced diameter portion of the housing 20 (e.g., the upper housing sub 23). When in the reduced diameter portion of the housing 20, the actuation ball seat 31 may be configured to receive a first ball 61 pumped through the bore 21. The actuation ball seat 31 may be biased into the reduced diameter portion of the housing 20 by a resilient member, such as a spring 33, that exerts a force on the shifter sleeve 30 in an uphole direction (to the left in FIG. 6A). Other resilient members, however, such as a series of Bellville or curved washers, may be used instead of a compression spring. The spring 33 may be positioned between an outwardly-projecting shoulder on the shifter sleeve 30 and a support ring 34 mounted within the intermediate housing sub 24.

Referring now to FIG. 6B, the downhole tool 10*z* may include an inner ring 45 and an outer ring 46. The inner and outer rings 45, 46 may be or include pawls, such as split rings, radially-reciprocating dogs, collet fingers, or any other ratcheting mechanism. The downhole tool 10*z* may also include a plurality of inner grooves 35 that are axially-offset from one another and a plurality of outer grooves 26 that are axially-offset from one another. As shown, the inner ring 45 is secured in place within a groove in the inner surface of the drive sleeve 40, and the inner grooves 35 are formed in the outer surface of the shifter sleeve 30. In another embodiment, the inner ring 45 may be secured in place within a groove in the outer surface of the shifter sleeve 30, and the inner grooves 35 may be formed in the inner surface of the drive sleeve 40. As shown, the outer ring 46 is secured in place within a groove in the inner surface of the intermediate housing sub 24, and the outer grooves 26 are formed in the outer surface of the drive sleeve 40. In another embodiment, the outer ring 46 may be secured in place within a groove in the outer surface of the drive sleeve 40, and the outer grooves 26 may be formed in the inner surface of the intermediate housing sub 24.

As shown in FIG. 6B, when the downhole tool 10*z* is run into the wellbore 1, the inner ring 45 may be positioned within in an initial inner groove 35, and the outer ring 46 may be positioned within in an initial outer groove 26. However, as discussed below, in other embodiments, the inner ring 45 and/or the outer ring 46 may not be positioned in the initial inner and outer grooves 35, 26 when the downhole tool 10*z* is run into the wellbore 1. Rather, the inner ring 45 and/or the outer ring 46 may be positioned in one of the intermediate grooves 35, 46.

Referring now to FIG. 6C, the valve sleeve ports 52 may be misaligned with the housing ports 22. In addition, the isolation ball seat 51 may be in an enlarged diameter portion (e.g., a recess) in the valve sleeve 50, which allows balls (e.g., the first ball 61) to pass through the isolation ball seat 51 without being received therein. In one example, the isolation ball seat 51 may be a split ring. The gap in the split ring may allow the two or more circumferentially-offset segments of the split ring to expand radially-outward when the split ring is positioned within the enlarged diameter portion of the valve sleeve 50.

Figure 7:
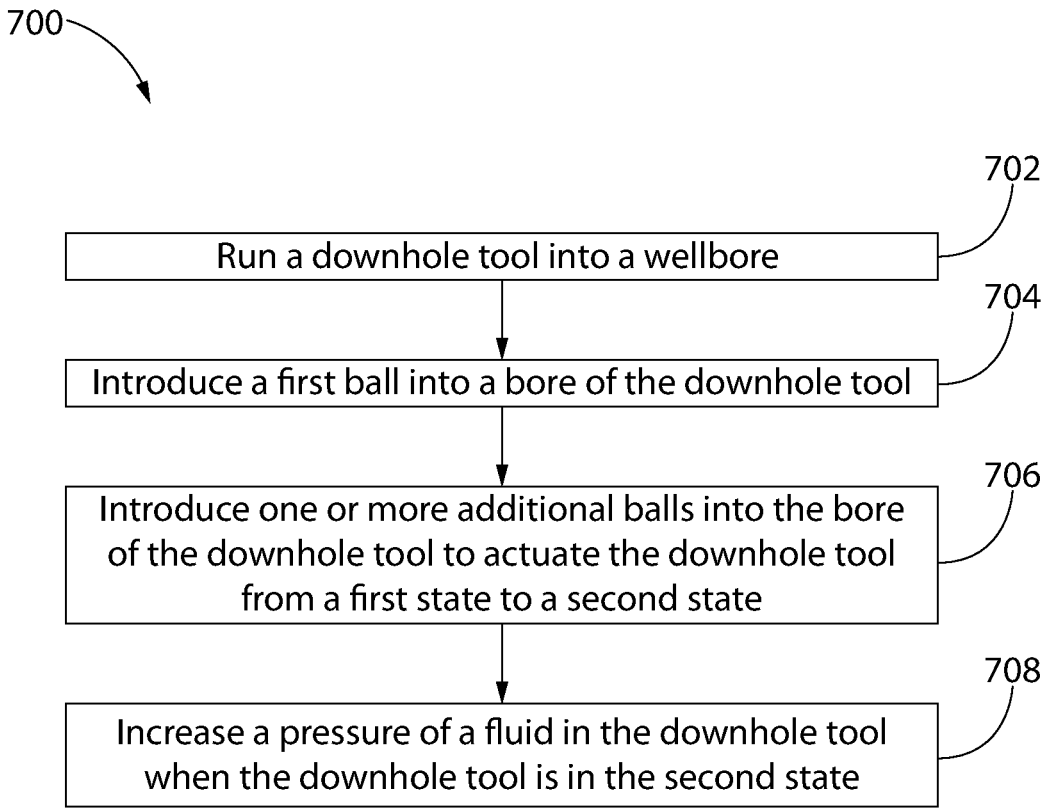
FIG. 7 illustrates a flowchart of a method for actuating the downhole tool from the first state to a second state, according to an embodiment.

FIG. 7 illustrates a flowchart of a method 700 for actuating the downhole tool 10*z*, according to an embodiment. FIGS. 6A-C, 8A-C, 9A-C, 10A-C, 11A-C, and 12A-C illustrate sequential stages of the method 700. The method 700 may begin by running the downhole tool 10*z* into the wellbore 1, as at 702. The downhole tool 10*z* may be coupled to a liner (e.g., production liner 2) in the wellbore 1. The method 700 may also include introducing the first ball 61 into the bore 21 of the downhole tool 10*z*, as at 704. This is shown in FIG. 6A. The first ball 61 may be introduced into the wellbore 1 at the surface, and a pump at the surface may generate hydraulic pressure above/behind the first ball 61 that causes the first ball 61 to flow into the bore 21 of the downhole tool 10. The first ball 61 may be received in the actuation ball seat 31.

Figure 8A:
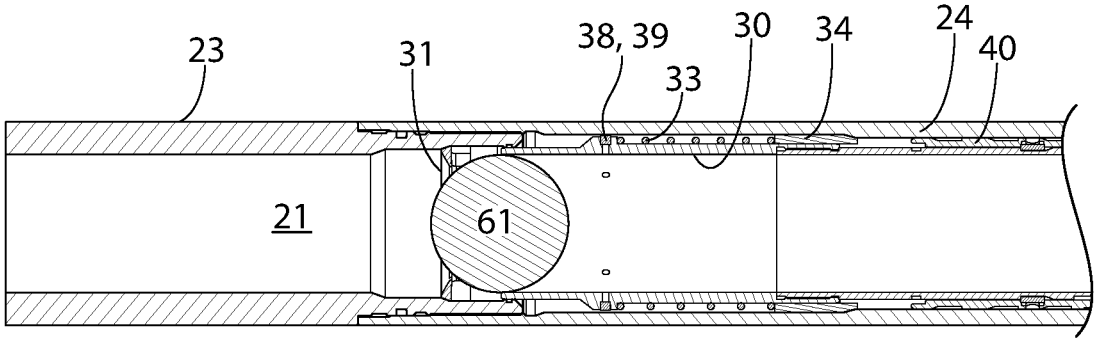
FIGS. 8A, 8B, and 8C illustrate axial cross-sectional views of the upper portion, the intermediate portion, and the lower portion of the downhole tool (e.g., sections A to C shown in FIG. 3) after a shifter sleeve has completed a down stroke in response to a first drop ball, according to an embodiment.

Referring now to FIG. 8A, once the first ball 61 is received in the actuation ball seat 31, the pressure above/behind the first ball 61 may cause the first ball 61 to exert a force on the actuation ball seat 31 in a first direction (to the right in FIG. 8A). A resilient member, such as a spring 33, may exert a force on the shifter sleeve 30 and/or the actuation ball seat 31 in an opposing direction (to the left in FIG. 8A). Other resilient members, however, such as a series of Bellville or curved washers, may be used instead of a compression spring. The spring 33 may be positioned between an outwardly-projecting shoulder on the shifter sleeve 30 and a support ring 34 mounted within the intermediate housing sub 24.

When the force exerted on the actuation ball seat 31 by the hydraulic pressure becomes greater than the opposing force exerted on the actuation ball seat 31 by the spring 33, the first ball 61, the actuation ball seat 31, and the shifter sleeve 30 may move together in the first direction (to the right in FIG. 8A) in what is referred to as a downward stroke. The actuation ball seat 31 and/or the shifter sleeve 30 may contact a shoulder at the end of the downward stroke to prevent further movement in the first direction. At the end of the downward stroke, the actuation ball seat 31 may be positioned within an enlarged diameter portion (e.g., a recess) formed in the housing 20 (e.g., in the upper housing sub 23) that allows the actuation ball seat 31 to expand radially-outward. For example, the actuation ball seat 31 may be a split ring having tapered upper portions for receiving the first ball 61. The gap in the split ring may allow the two or more circumferentially-offset segments of the split ring to expand radially-outward into the enlarged diameter portion of the upper housing sub 23. When the actuation ball seat 31 expands radially-outward, the actuation ball seat 31 may release the first ball 61, allowing the first ball 61 to pass therethrough in the first direction.

Figure 8B:
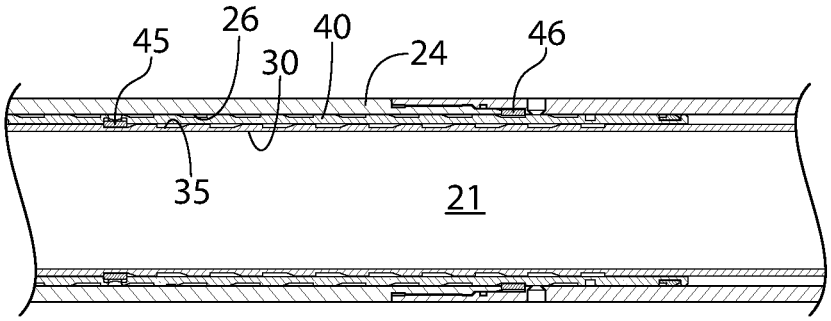

Referring now to FIG. 8B, as the shifter sleeve 30 is moving in the first direction (to the right in FIG. 8B), the inner ring 45 may couple the shifter sleeve 30 to the drive sleeve 40 such that the drive sleeve 40 also moves in the first direction. This may cause the outer ring 46 to slide out of the initial outer groove 26 and into a second outer groove 26, as shown in FIG. 8B. More particularly, the upper surface of the outer ring 46 and/or the upper surfaces of the outer grooves 26 may be inclined, allowing the outer ring 46 to slide from the initial outer groove 26 into the second outer groove 26 when the drive sleeve 40 moves in the first direction with respect to the intermediate housing sub 24.

Figure 8C:
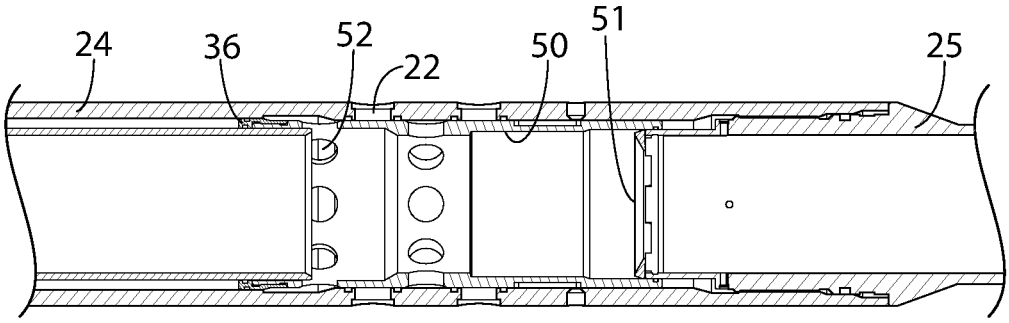

Referring now to FIG. 8C, the valve sleeve ports 52 may remain misaligned with the housing ports 22. In addition, the isolation ball seat 51 may remain in the enlarged diameter portion (e.g., a recess) in the valve sleeve 50.

Figure 9A:
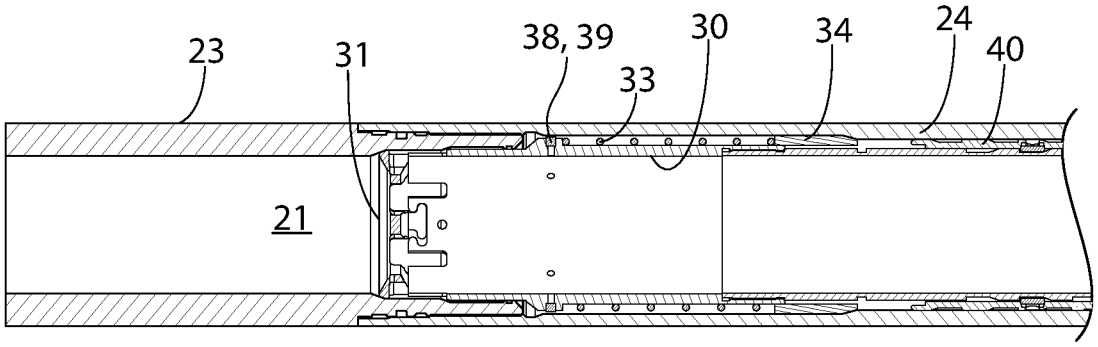
FIGS. 9A, 9B, and 9C illustrate axial cross-sectional views of the upper portion, the intermediate portion, and the lower portion of the downhole tool (e.g., sections A to C shown in FIG. 3) after a drive sleeve has indexed one unit down and the first drop ball is passing though the downhole tool, according to an embodiment.

Referring now to FIG. 9A, once the first ball 61 passes through the actuation ball seat 31, the spring 33 may push the actuation ball seat 31 and the shifter sleeve 30 in the second direction (to the left in FIG. 9A) until the actuation ball seat 31 and the shifter sleeve 30 are once again in their initial position. As the actuation ball seat 31 moves in the second direction in what is referred to as an upward stroke, the actuation ball seat 31 may move back into the reduced diameter portion of the housing 20 (e.g., the upper housing sub 23), such that the actuation ball seat 31 is ready to receive a second ball.

Figure 9B:
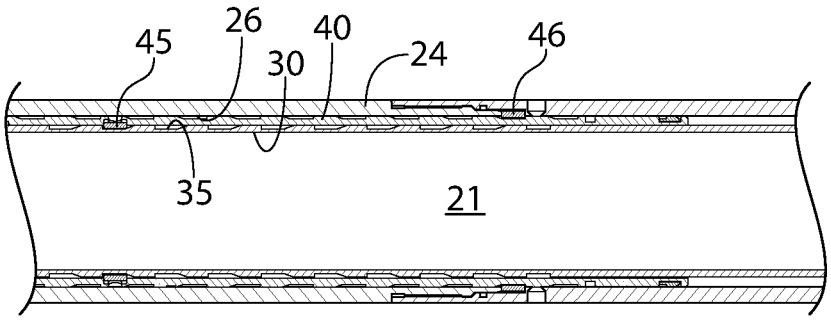

Referring now to FIG. 9B, as the shifter sleeve 30 is moving in the second direction (e.g., to the left in FIG. 9B), the outer ring 46 may couple the drive sleeve 40 to the intermediate housing sub 24 such that the drive sleeve 40 does not move together with the shifter sleeve 30. This may cause the inner ring 45 to slide out of the initial inner groove 35 and into a second inner groove 35, as shown in FIG. 9B. More particularly, the lower surface of the inner ring 45 and/or the lower surfaces of the inner grooves 35 may be inclined, allowing the inner ring 45 to slide from the initial inner groove 35 into the second inner groove 35 when the shifter sleeve 30 moves in the second direction with respect to the drive sleeve 40. As a result, the downward and upward stroke of the shifter sleeve 30 may cause the drive sleeve 40 to move (i.e., index) downward by a predetermined distance toward the valve sleeve 50. The predetermined distance may be the distance between two of the outer grooves 26.

Figure 9C:
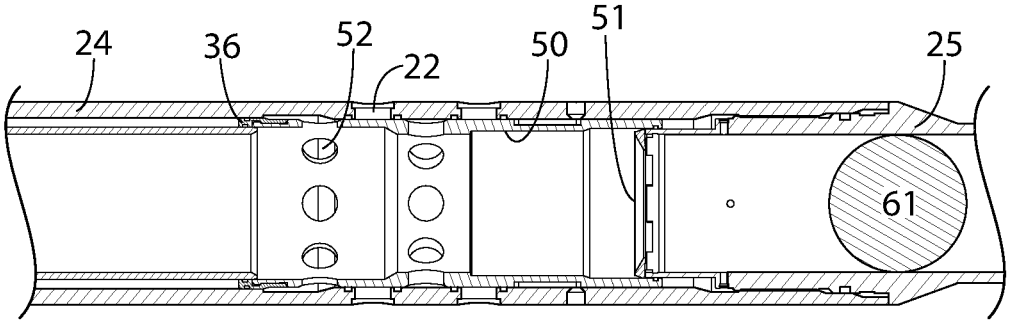

Referring now to FIG. 9C, the valve sleeve ports 52 may remain misaligned with the housing ports 22. In addition, the isolation ball seat 51 may remain in the enlarged diameter portion (e.g., a recess) in the valve sleeve 50. As such, the first ball 61 may pass through the isolation ball seat 51 and out of the lower end of the downhole tool 10*z*.

The method 700 may also include introducing one or more additional balls into the bore 21 of the downhole tool 10*z*, as at 706. Each additional ball may pass through the downhole tool 10*z* in the manner described above, causing the drive sleeve 40 to move (i.e., index) downward by the predetermined distance. More particularly, each additional ball may cause the inner ring 45 to move into a lower groove 35 on the downward stroke of the shifter sleeve 30 and subsequently cause the outer ring 46 to move into a lower groove 26 on the upward stroke of the shifter sleeve 30, thereby causing the drive sleeve 40 to move (i.e., index) downward by the predetermined distance. Each time the drive sleeve 40 moves (i.e., indexes) down, the drive sleeve 40 moves closer to the valve sleeve 50.

Figure 10A:
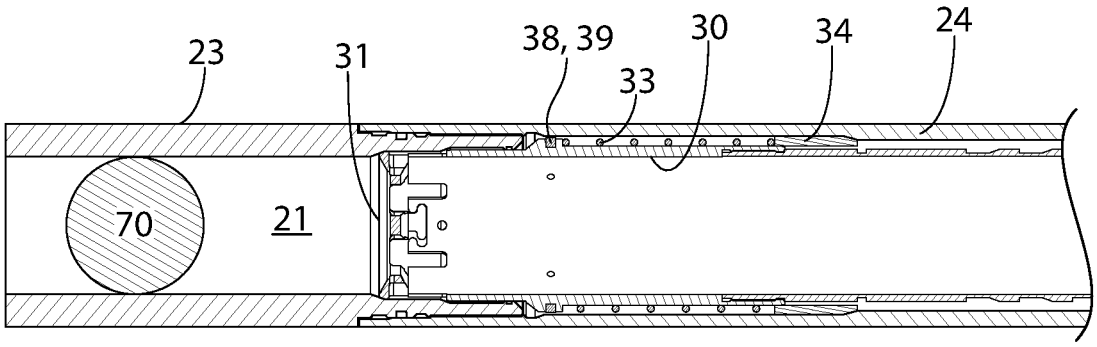
FIGS. 10A, 10B, and 10C illustrate axial cross-sectional views of the upper portion, the intermediate portion, and the lower portion of the downhole tool (e.g., sections A to C shown in FIG. 3) after the drive sleeve has been fully indexed and a tenth drop ball is approaching an actuation ball seat, according to an embodiment.
Figure 10B:
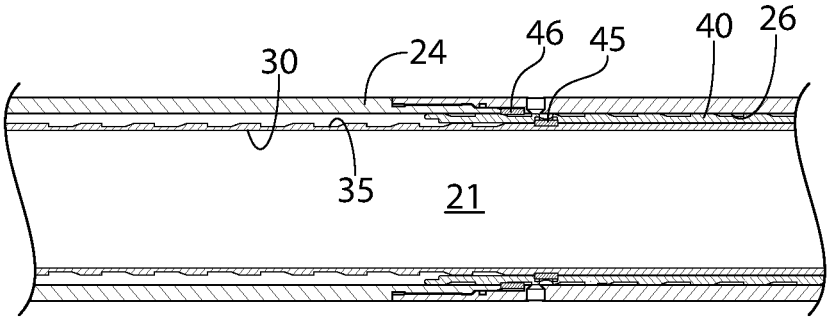

Referring now to FIGS. 10A and 10B, once the inner ring 45 and the outer ring 46 are in the final groove 35, 26, another ball 70 may be introduced into the bore 21 of the downhole tool 10. In this particular embodiment, this ball 70 is the tenth ball introduced; however, the number of balls may depend at least partially upon the number of inner grooves 35 and outer grooves 26 and/or the inner and outer grooves 35, 26 in which the rings 45, 46 are positioned when the downhole tool 10*z* is run into the wellbore 1.

Figure 10C:
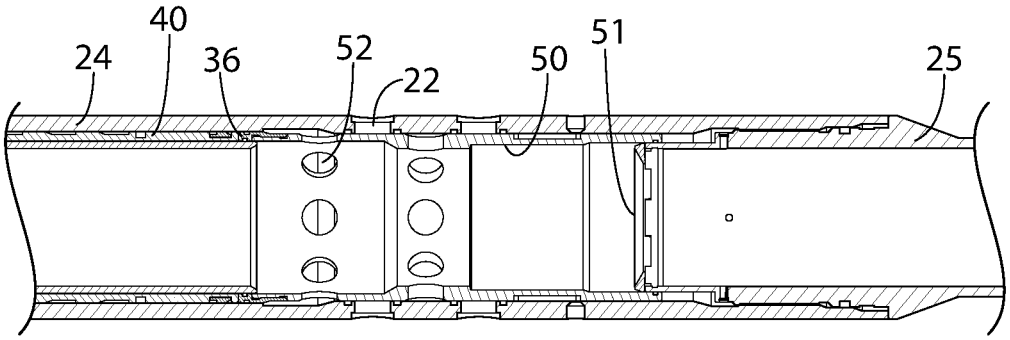

Referring now to FIG. 10C, the valve sleeve ports 52 may remain misaligned with the housing ports 22. In addition, the isolation ball seat 51 may remain in the enlarged diameter portion (e.g., a recess) in the valve sleeve 50. The drive sleeve 40 may, however, now be in contact, or almost in contact, with the valve sleeve 50.

Figure 11A:
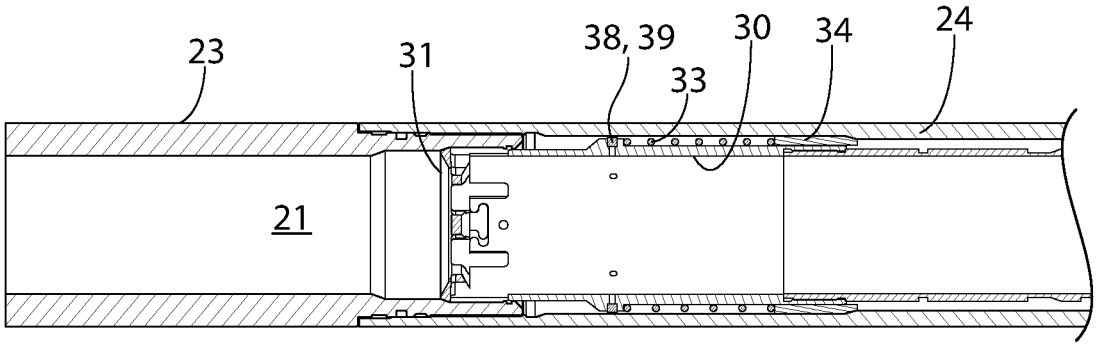
FIGS. 11A, 11B, and 11C illustrate axial cross-sectional views of the upper portion, the intermediate portion, and the lower portion of the downhole tool (e.g., sections A to C shown in FIG. 3) after the tenth drop ball has seated in an isolation ball seat in a valve sleeve and actuated the downhole tool into a second (e.g., open) state, according to an embodiment.

Referring now to FIG. 11A, the tenth ball 70 may cause the actuation ball seat 31 and the shifter sleeve 30 to perform another downward stroke. When the inner and outer rings 45, 46 are already in their final grooves 35, 26, however, the actuation ball seat 31 and the shifter sleeve 30 may be secured in place at the bottom of the downward stroke rather than return to the initial position. As a result, the actuation ball seat 31 may be positioned/secured in the enlarged diameter portion (e.g., a recess) in the housing 20.

Figure 11B:
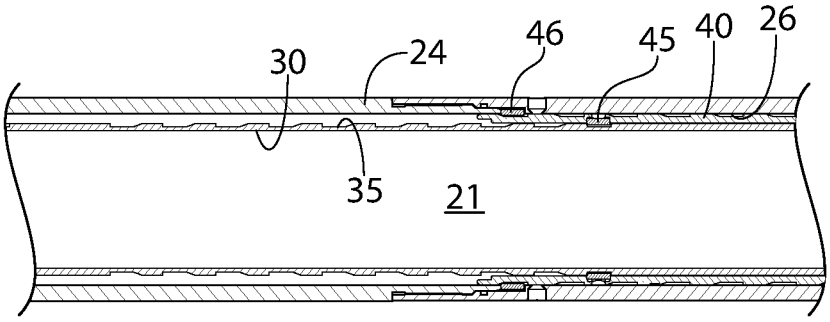
Figure 11C:
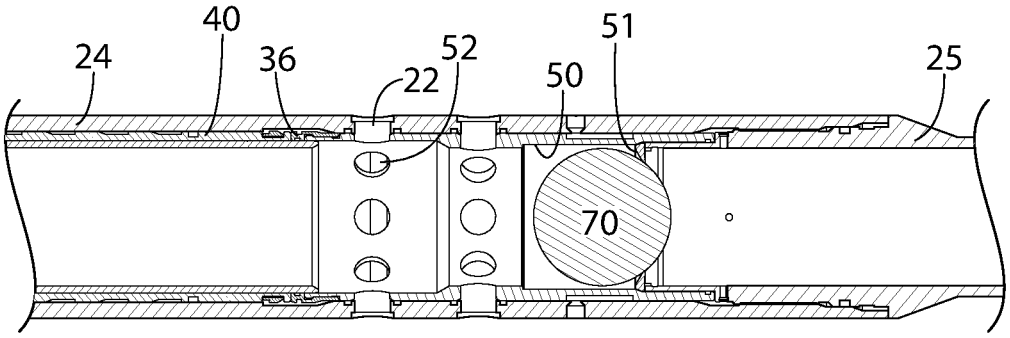

Referring now to FIGS. 11B and 11C, the downward stroke of the shifter sleeve 30, caused by the tenth ball 70, may cause the drive sleeve 40 to push the valve sleeve 50 in the first direction (to the right in FIG. 11C) from a first position (FIGS. 7C-10C) to a second position (FIG. 11C). In the second position, the valve sleeve ports 52 may be aligned with the housing ports 22. As a result, a path of fluid communication may exist between the bore 21 and the exterior of the downhole tool 10*z* through the ports 22, 52. At this point, the downhole tool 10*z* may be referred to as in a second (e.g., open) state. In addition, when the valve sleeve 50 shifts into the second position, the isolation ball seat 51 may shift into a reduced diameter portion in the valve sleeve 50. More particularly, the isolation ball seat 51 may be in contact with the upper end of the lower housing sub 25. Thus, the isolation ball seat 51 may remain substantially stationary with respect to the housing 20 as the valve sleeve 50 moves with respect to the housing 20, causing the isolation ball seat 51 to shift into the reduced diameter portion in the valve sleeve 50. As a result, the isolation ball seat 51 may receive the tenth ball 70.

The method 700 may then include increasing a pressure of a fluid in the bore 21 of the downhole tool 10*z*, as at 708. More particularly, the pump at the surface may generate hydraulic pressure above/behind the tenth ball 70. As the tenth ball 70 is positioned within the isolation ball seat 51 and preventing fluid flow therethrough, the pressure in the bore 21 may increase, which may cause at least a portion of the fluid to flow from the bore 21, through the aligned ports 22, 52, and to the exterior of the downhole tool 10*z* where the fluid may generate a fracture 9 in the formation 6 (see FIGS. 1A, 1B).

As described above with reference to FIGS. 1A and 1B, the liner 2 may include multiple downhole tools 10*a-d*, 10*w-z* that may be actuated from the first (e.g., closed) state to the second (e.g., open) state proceeding from the lowermost downhole tool (e.g., 10*a*) to the uppermost downhole tool (e.g., 10*z*). To accomplish this, one or more of the downhole tools 10*a-d*, 10*w-z* may be indexed to varying degrees at the surface before being run into the wellbore 1. For example, the lowermost downhole tool 10*a* may be indexed at the surface such that the inner and outer rings 45, 46 are in the final grooves 35, 26 before being run into the wellbore 1. The next lowest downhole tool 10*b* may be indexed at the surface such that the inner and outer rings 45, 46 are in the next-to-final grooves 35, 26, and so on proceeding to the uppermost downhole tool 10*z*. A sight hole may allow the operator at the surface to see and confirm the index position for each downhole tool 10*a-d*, 10*w-z* before the downhole tools 10*a-d*, 10*w-z* are run into the wellbore 1.

Thus, once the liner 2 with the downhole tools 10*a-d*, 10*w-z* is positioned within the wellbore 1, the first ball 61 may pass through each of the downhole tools 10*a-d*, 10*w-z* beginning with the uppermost downhole tool 10*z* and proceeding until finally passing through the lowermost downhole tool 10*a*. The first ball 61 may cause each of the downhole tools 10*a-d*, 10*w-z* to index a first time. For example, indexing the uppermost downhole tool 10*z* may cause the inner and outer rings 45, 46 to shift into the second grooves 35, 26 but the uppermost downhole tool 10*z* may remain in the first (e.g., closed) state, as shown in FIGS. 8B and 9B. When the first ball 61 reaches the next lowest downhole tool 10*b*, it may cause the next lowest downhole tool 10*b* to index. Indexing the next lowest downhole tool 10*b* with the first ball 61 may cause the inner and outer rings 45, 46 to shift into the final grooves 35, 26 but the next lowest downhole tool 10*b* may remain in the first (e.g., closed) state. The first ball 61 may then cause the lowermost downhole tool 10*a* to index. As the lowermost downhole tool 10*a* already has the inner and outer rings 45, 46 are in the final grooves 35, 26, indexing the lowermost downhole tool 10*a* with the first ball 61 may cause the lowermost downhole tool 10*a* to actuate from the first (e.g., closed) state to the second (e.g., open state).

Once the lowermost downhole tool 10*a* is in the open state, the pressure of the fluid in the bore 21 may be increased (as at step 608) to generate one or more fractures 9 in the portion of formation 6 adjacent to the lowermost downhole tool 10*a* (see FIGS. 1A and 1B). After the fracture(s) are generated in the portion of formation 6 adjacent to the lowermost downhole tool 10*a*, a second ball may be introduced into the wellbore 1. The second ball may cause each of the downhole tools 10*b-d*, 10*w-z* to index a second time. For example, indexing the uppermost downhole tool 10*z* a second time may cause the inner and outer rings 45, 46 to shift into the third grooves 35, 26, but the uppermost downhole tool 10*z* may remain in the first (e.g., closed) state. As the next lowest downhole tool 10*b* has the inner and outer rings 45, 46 in the final grooves 35, 26 after the first ball 61, indexing the next lowest downhole tool 10*b* a second time with the second ball may cause the next lowest downhole tool 10*b* to actuate from the first (e.g., closed) state to the second (e.g., open state).

Once the next lowest downhole tool 10*b* is in the open state, the pressure of the fluid in the bore 21 may be increased (as at step 608) to generate one or more fractures 9 in the portion of formation 6 adjacent to the next lowest downhole tool 10*b* (see FIGS. 1A and 1B). This process may be repeated to sequentially actuate each of the downhole tools 10*a-d*, 10*w-z* proceeding from the lowermost downhole tool 10*a* to the uppermost downhole tool 10*z*.

Once each of the downhole tools 10*a-d*, 10*w-z* is in the open state, production may begin. In other words, fluids from the formation 6 may flow into the bore 21 (e.g., through the aligned ports 22, 52) in each of the downhole tools 10*a-d*, 10*w-z*. The fluids may flow upward through the bore 21 to the surface.

Referring again to FIGS. 11A-C, the fluids (e.g., hydrocarbons) may cause the tenth ball 70 to lift from the isolation ball seat 51 and flow through the bore 21 in the second direction (to the left in FIGS. 11A-C). As the actuation ball seat 31 is in the enlarged diameter portion, the tenth ball 70 may pass through the actuation ball seat 31 and out of the downhole tool 10.

Figure 12A:
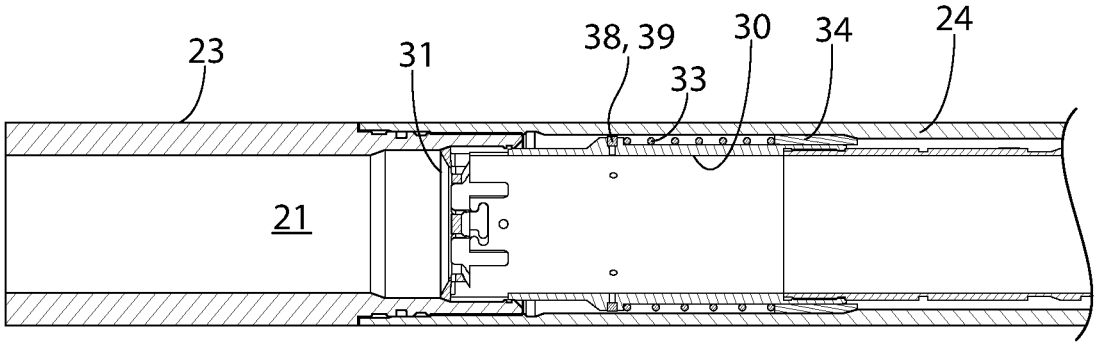
FIGS. 12A, 12B, and 12C illustrate axial cross-sectional views of the upper portion, the intermediate portion, and the lower portion of the downhole tool (e.g., sections A to C shown in FIG. 3) after a ninth drop ball has displaced and flowed back past the isolation ball seat in the valve sleeve, according to an embodiment.
Figure 12B:
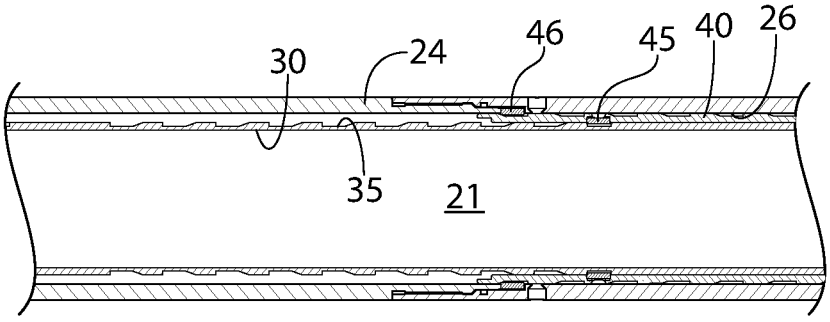
Figure 12C:
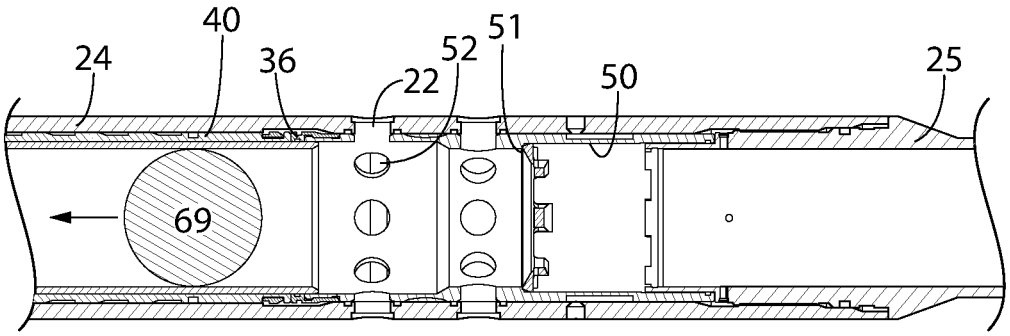

Referring now to FIGS. 12A-C, the remaining balls (e.g., ball nine 69-ball one 61) may also flow in the second direction and back into and eventually through the downhole tool 10*z*. As shown, the ninth ball 69 may flow back into the bore 21 and be received on a lower side of the isolation ball seat 51. The pressure of the fluid pushing the ninth ball 69 may cause the isolation ball seat 51 to shift (e.g., to the left) into an enlarged diameter portion, allowing the isolation ball seat 51 to expand again such that the ninth ball 69 may pass therethrough. The ninth ball 69 may then pass through the actuation ball seat 31, which is also expanded in an enlarged diameter portion. The remaining balls (e.g., including the first ball 61) may pass through the downhole tool 10 in the same manner.

In another embodiment, one, some, or all of the balls 61-69 may be dissolvable within the wellbore. In such an embodiment, the balls 61-69 may not flow back through the bore 21, but may disintegrate in situ when contacted by a predetermined fluid, for a predetermined time, at a predetermined temperature, or any combination thereof.

As used herein, the terms "inner" and "outer"; "up" and "down"; "upper" and "lower"; "upward" and "downward"; "above" and "below"; "inward" and "outward"; "uphole" and "downhole"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A downhole tool, comprising:

a housing having a housing port formed radially-therethrough;

a shifter sleeve positioned within the housing, wherein the shifter sleeve has a port formed radially therethrough;

a drive sleeve positioned at least partially within an annulus between the housing and the shifter sleeve, wherein downward movement of the shifter sleeve causes the drive sleeve to move downward, and wherein downward movement of the drive sleeve causes fluid to flow through the port in the shifter sleeve and into the annulus;

a valve sleeve positioned within the housing and below the drive sleeve;

a filter coupled to the shifter sleeve and configured to prevent particles from flowing through the port in the shifter sleeve and into the annulus; and a piston positioned within the annulus, wherein the piston is directly coupled to an upper end of the valve sleeve, and wherein the piston comprises a seal that restricts fluid flow in the annulus from a first axial side of the piston to a second axial side of the piston.

2. The downhole tool of claim 1, wherein the filter comprises a sintered metal material that is positioned at least partially in the port in the shifter sleeve.

3. The downhole tool of claim 1, wherein the valve sleeve has a valve sleeve port formed radially-therethrough, and wherein the housing port and the valve sleeve port are misaligned when the downhole tool is in a first state and aligned when the downhole tool is in a second state.

4. The downhole tool of claim 3, wherein the piston is positioned between the drive sleeve and the valve sleeve.

5. The downhole tool of claim 3, further comprising a resilient member that exerts a force on the shifter sleeve in an uphole direction, wherein the piston is positioned at least partially between the resilient member and the valve sleeve.

6. The downhole tool of claim 5, further comprising a support ring, wherein the resilient member is positioned between the shifter sleeve and the support ring, and wherein the piston is positioned at least partially between the support ring and the valve sleeve.

7. The downhole tool of claim 1, wherein the piston is configured to maintain a balanced pressure in the annulus during the downward movement of the shifter sleeve, the drive sleeve, or both.

8. The downhole tool of claim 1, wherein the seal comprises:

a first seal on an inner surface of the piston to contact the shifter sleeve; and a second seal on an outer surface of the piston to contact the housing.

9. The downhole tool of claim 8, wherein the first seal is positioned at least partially within a first recess in the inner surface of the piston, and wherein the second seal is positioned at least partially within a second recess in the outer surface of the piston.

10. A downhole tool, comprising:

a housing having a housing port formed radially-therethrough;

a shifter sleeve positioned within the housing, wherein the shifter sleeve has a port formed radially therethrough;

an actuation ball seat coupled to and configured to move together with the shifter sleeve;

a drive sleeve positioned at least partially within an annulus between the housing and the shifter sleeve, wherein downward movement of the shifter sleeve causes the drive sleeve to move downward, and wherein downward movement of the drive sleeve causes fluid to flow through the port in the shifter sleeve and into the annulus;

a filter coupled to the shifter sleeve and configured to prevent particles from flowing through the port in the shifter sleeve and into the annulus;

a piston positioned within the annulus, wherein the piston comprises a first seal on an inner surface thereof to contact the shifter sleeve and a second seal on an outer surface thereof to contact the housing;

a valve sleeve positioned within the housing and below the drive sleeve, wherein an upper end of the valve sleeve is directly coupled to the piston, and wherein the valve sleeve has a valve sleeve port formed radially-therethrough that is misaligned with the housing port when the valve sleeve is in a first position and aligned with the housing port when the valve sleeve is in a second position; and an isolation ball seat positioned at least partially within the valve sleeve.

11. The downhole tool of claim 10, wherein the filter comprises a sintered metal material that is positioned at least partially in the port in the shifter sleeve.

12. The downhole tool of claim 10, wherein the piston is positioned within the annulus and between the drive sleeve and the valve sleeve.

13. The downhole tool of claim 10, further comprising an inner ring positioned radially-inward from the drive sleeve, wherein the inner ring remains positioned in a first inner groove in the shifter sleeve or the drive sleeve during downward movement of the shifter sleeve and the drive sleeve, and wherein the inner ring shifts into a second inner groove in the shifter sleeve or the drive sleeve during subsequent upward movement of the shifter sleeve.

14. The downhole tool of claim 10, further comprising an outer ring positioned radially-outward from the drive sleeve, wherein the outer ring shifts from a first outer groove into a second outer groove in the drive sleeve or the housing during downward movement of the shifter sleeve and the drive sleeve, and wherein the outer ring remains positioned in the second outer groove during subsequent upward movement of the shifter sleeve.

15. The downhole tool of claim 10, wherein the actuation ball seat is configured to move into an enlarged diameter portion of the housing and expand radially therein at an end of the downward movement.

16. The downhole tool of claim 15, wherein the actuation ball seat is configured to remain secured in the enlarged diameter portion of the housing when the housing port becomes aligned with the valve sleeve port.

17. The downhole tool of claim 16, wherein the isolation ball seat is configured to move from a first enlarged diameter portion of the valve sleeve into a reduced diameter portion of the valve sleeve when the housing port becomes aligned with the valve sleeve port, wherein the isolation ball seat is configured to receive a first ball travelling in a downhole direction when in the reduced diameter portion of the valve sleeve.

18. The downhole tool of claim 17, wherein the isolation ball seat is configured to move from the reduced diameter portion of the valve sleeve into a second enlarged diameter portion of the valve sleeve in response to a second ball travelling in an uphole direction contacting the isolation ball seat.

19. A method for actuating a downhole tool, comprising:

running the downhole tool into a wellbore; and introducing a first ball into a bore of the downhole tool, wherein:

the first ball is received in an actuation ball seat of the downhole tool and causes the actuation ball seat and a shifter sleeve coupled thereto to move downward within a housing of the downhole tool, downward movement of the shifter sleeve causes a drive sleeve to move downward within the housing, downward movement of the drive sleeve causes fluid to flow through a port in the shifter sleeve and into an annulus between the housing and the shifter sleeve, a piston in the annulus is directly coupled to an upper end of a valve sleeve that is positioned within the housing and below the drive sleeve, the piston comprises a seal that is configured to maintain a balanced pressure in the annulus during the downward movement of the shifter sleeve, the drive sleeve, or both, and a filter coupled to the shifter sleeve prevents particles from flowing through the port in the shifter sleeve and into the annulus.

20. The method of claim 19, wherein the first ball causes the drive sleeve to index down by a predetermined distance, causing the drive sleeve to move closer to the valve sleeve.

21. The method of claim 20, further comprising introducing a second ball into the bore of the downhole tool, wherein the second ball causes the drive sleeve to actuate the valve sleeve from a first position to a second position, wherein a valve sleeve port in the valve sleeve is misaligned with a housing port in the housing when the valve sleeve is in the first position, and wherein the valve sleeve port in the valve sleeve is aligned with the housing port in the housing when the valve sleeve is in the second position.

22. The method of claim 21, wherein the second ball is received in an isolation ball seat positioned within the valve sleeve, and further comprising increasing a pressure of a fluid in the bore, causing at least a portion of the fluid to flow out of the bore, through the valve sleeve port and the housing port, and to an exterior of the downhole tool.

23. The method of claim 22, further comprising indexing the drive sleeve down by the predetermined distance one or more times before running the downhole tool into the wellbore.

* * * * *